US008313099B2

(12) United States Patent
Otto

(10) Patent No.: US 8,313,099 B2
(45) Date of Patent: Nov. 20, 2012

(54) METHOD AND DEVICE FOR THE ALIGNMENT OF A SHEET

(75) Inventor: Volker Otto, Gettorf (DE)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 12/281,002

(22) PCT Filed: Sep. 21, 2006

(86) PCT No.: PCT/EP2006/009174

§ 371 (c)(1),
(2), (4) Date: Jan. 16, 2009

(87) PCT Pub. No.: WO2007/098794

PCT Pub. Date: Sep. 7, 2007

(65) Prior Publication Data

US 2009/0218759 A1 Sep. 3, 2009

(30) Foreign Application Priority Data

Mar. 2, 2006 (DE) ..... 10 2006 010 249

(51) Int. Cl.
*B65H 29/00* (2006.01)

(52) U.S. Cl. ..... 271/185; 271/186; 198/405; 414/758; 414/759

(58) Field of Classification Search ..... 271/185, 271/186; 198/405; 414/758, 759
See application file for complete search history.

(56) References Cited

U.S. PATENT DOCUMENTS

| | | | | |
|---|---|---|---|---|
| 2,947,406 | A | 8/1960 | Hazelton | |
| 3,838,771 | A * | 10/1974 | Whiteford | 198/405 |
| 4,226,324 | A * | 10/1980 | Stocker | 198/405 |
| 6,626,103 | B2 * | 9/2003 | Neumann | 101/230 |
| 7,036,654 | B2 * | 5/2006 | Frost | 198/406 |
| 2001/0028145 | A1 | 10/2001 | Fukatsu | |
| 2003/0066445 | A1 | 4/2003 | Neumann | |

FOREIGN PATENT DOCUMENTS

| | | |
|---|---|---|
| DE | 30 06 266 | 9/1981 |
| DE | 3716454 A * | 11/1988 |

* cited by examiner

*Primary Examiner* — Luis A Gonzalez

(57) ABSTRACT

The invention relates to a method for the alignment of a sheet in a direction transverse (cross-track) to its transport direction in a sheet-printing machine, in particular in a digital printing machine, preferably in an electrographically operating printing machine. The object of the invention is to improve, in a simple manner, a method and a device of the aforementioned generic types in view of a first rough alignment of the individual sheet. Referring to the method, this object is achieved in accordance with the invention in that the individual sheet is flipped about a preferably non-physical, mathematical or imagined flipping axis extending in transport direction, and that this flipping produces a transverse offset of the sheet in transverse direction.

6 Claims, 2 Drawing Sheets

METHOD AND DEVICE FOR THE ALIGNMENT OF A SHEET

Figure 1:
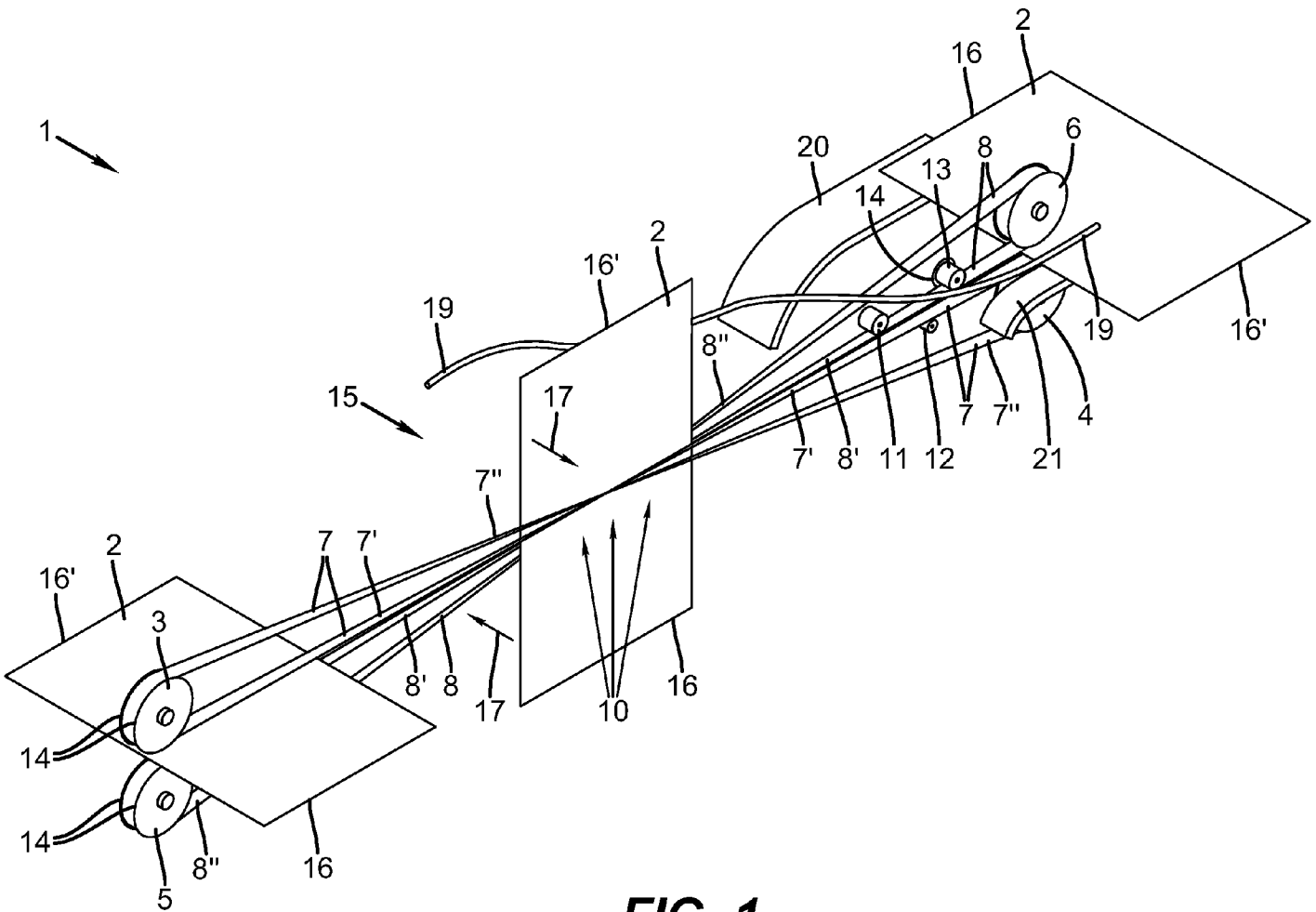
FIG. 1 (PRIOR ART)

The invention relates to a method for the alignment of a sheet in a direction transverse (cross-track) to its transport direction in a sheet-printing machine, in particular in a digital printing machine, preferably in an electrographically operating printing machine.

Furthermore, the invention relates to a device for the alignment of a sheet in a direction transverse (cross-track) to its transport direction in a sheet-printing machine, in particular in a digital printing machine, preferably in an electrographically operating printing machine.

A device for the alignment of a sheet in a direction transverse to its transport direction in a printing machine is known, for example, from DE 100 23 290 A1. Such a device can be used specifically for the registered alignment of a sheet that is to be printed.

However, such a device features only a limited operating range. For example, as a result of an unfortunate and unfavorable accumulation of manufacturing tolerances in a printing machine, it may still happen that a sheet that is to be aligned is so erroneously transported to a device of the aforementioned type that said sheet is outside the operating range of said device and can no longer be corrected by said device. This may potentially lead to a non-specific error message, stopping of the printing machine and a subsequent, time-consuming search for errors. As a rule, this occurs already when a printing machine is set up and it is test run after it has been manufactured at the manufacturing plant, and can thus delay the delivery, or result in an overall impairment of the virtually finished machine.

In order to eliminate this systematic problem, it could, for example, become necessary to re-arrange an alignment device of the cited type—which is quite complex and sensitive—in the machine and thus redesign the machine in a not insignificant manner.

Therefore, the object of the invention is to improve, in a simple manner, a method and a device of the aforementioned generic types in view of a first rough alignment of the individual sheet.

Referring to the method, this object is achieved in accordance with the invention in that the individual sheet is flipped about a preferably non-physical, mathematical or imagined flipping axis extending in transport direction, and that this flipping produces a transverse offset of the sheet in transverse direction.

Therefore, in accordance with the invention, a suitable and preferably already existing flipping device is utilized in an advantageous, clever and simple manner to impart the individual sheet with a rough transverse alignment due to being flipped.

In particular, a device as is known from DE 100 59 913 C2 could be used as such a flipping device. Such a flipping device comprises, in particular, belt-like flipping webs approximately extending in transport direction and grasping and clamping between them the sheet by its two surfaces, said flipping webs being guided in a crossed and rotated manner such that they flip the sheet during its transport about a flipping axis extending approximately in transport direction, which also characterizes the inventive device by independently solving the technical problem of alignment, for which device independent protection is also claimed.

A preferred modification of the inventive method provides that the sheet be flipped about a flipping axis, which is eccentrically offset by a distance parallel to its central axis extending in transport direction in such a manner that, due to the turn-over, the transverse offset exhibits approximately twice the size as the aforementioned distance between the flipping axis and the central axis. As a result of this, it is possible in a simple and effective manner to create a relatively large and defined transverse offset for the individual sheet. In particular, referring to the device, it is significantly simpler to allow the sheet to enter a flipping device off-center or to allow the flipping device to grasp the sheet off-center than to re-construct or even re-engineer a complex, precision-mechanical alignment device.

A possible alternative would be that, in order to generate the transverse offset by flipping, the sheet is transported—as it is being flipped—through a flipping device in a direction that is skewed relative to the transport direction; however, in this case it is more difficult to create an accurately defined transverse offset and to set up and align the flipping device accordingly.

In any event, provisions can be made that a flipping device is used that can be adjusted or offset.

As already mentioned, an inventive device for the alignment of a sheet in a direction transverse (cross-track) to its transport direction in a sheet printing machine, in particular for carrying out the inventive method, is characterized in that said device comprises a flipping device for flipping the sheet, said flipping device comprising belt-like flipping webs approximately extending in transport direction and grasping and clamping between them the sheet between its two surfaces, said flipping webs being crossed relative to each other and guided in a rotated manner such that they flip the sheet during transport about a flipping axis extending in transport direction.

In this arrangement, the flipping webs can be preferably arranged such that they are offset parallel to each other; however, the flipping webs can also be aligned in a direction that is skewed relative to the transport direction.

In particular, deflecting rollers guiding the flipping webs could be shifted continuously individually, or together, in cross-track direction, for example, on spindles, toothed racks or the like. A particularly simple preferred embodiment of the inventive device, however, provides that the deflecting rollers guiding the transport webs can be offset cross-track individually, or together, with the use of spacers 36. In so doing, it must be taken into consideration that, as described in detail farther above, such an alignment of the flipping webs will probably be required only once after the manufacture of the printing machine and after determining the required offset prior to the final delivery of the machine to the customer. By contrast, such an alignment will not be required again during operation of the machine at the customer site.

As has also been already mentioned, the inventive measures make particular sense and are particularly appropriate, without being restricted thereto, when the inventive flipping device cooperates or interacts with a generally known sheet alignment device that is located downstream in transport direction.

The drawings show in

Figure 2:
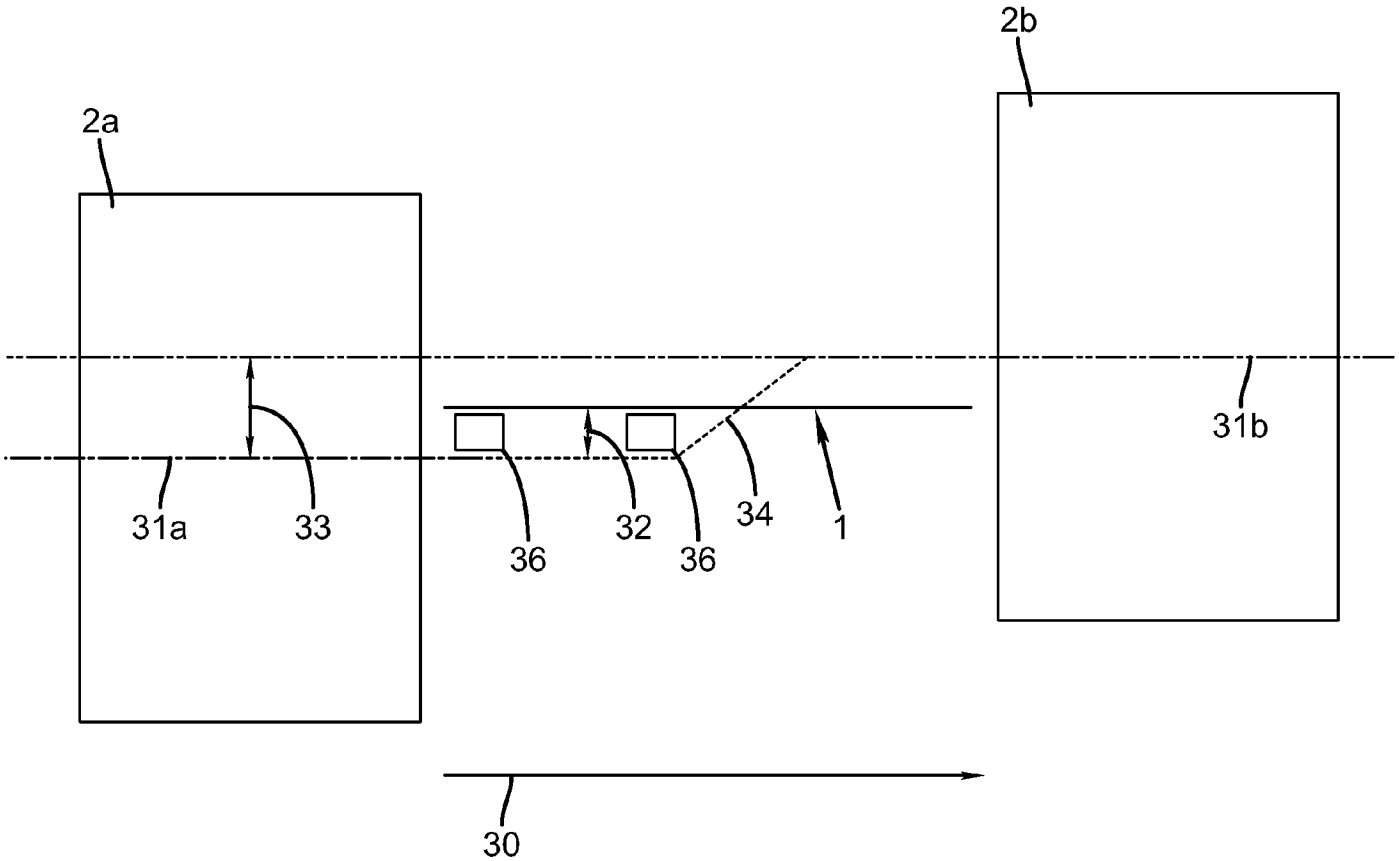

FIG. 1 a perspective view of a prior-art flipping device,

FIG. 2 an only highly schematic plan view of an inventive flipping device.

FIG. 1 shows an exemplary embodiment of a flipping device disclosed by prior art in accordance with document DE 100 59 913 A1.

A sheet 2, in particular a printing material, is transported through the flipping device 1 (in the direction to the right in the drawing). The transport and the flipping operation take place by means of two belts 7, 8 which are arranged in such a manner that two web segments 7' and 8' extend in transport direction and thus transport the sheet 2 clamped between them. In this arrangement, the belts 7, 8 are crossed or turned in such a manner that, upstream of one crossing region 10, the segment 7' is at the top and the segment 8' is at the bottom and, downstream of the crossing region 10, the segment 8' is at the top and the segment 7' is at the bottom. As a result of this crossing of the belts 7, 8, the sheet 2 held between the segments 7', 8' is flipped by 180 degrees about is in-track axis, so that, after the flipping operation, the two outer edges 16, 16' are interchanged and the former underside is at the top. The advantage of such a flipping device, compared with a turnover pocket, for example, is that, after flipping, the same lead edge of the sheet 2 continues to point in transport direction.

The belts 7, 8 are supported by the deflecting rollers 3, 4, 5 and 6. The belt 7 is supported by an upper deflecting roller 3 and by a lower deflecting roller 4. Between the lower side of the deflecting roller 3 and the upper side of the deflecting roller 4, there is the segment 7' guiding the sheet 2, and from the lower side of the deflecting roller 4 to the upper side of the deflecting roller 3, there is the returning segment 7". Correspondingly, from the lower deflecting roller 5 at the top to the upper deflecting roller 6 at the bottom, there is the segment 8' of the belt 8 guiding the sheet 2, and from the upper side of the deflecting roller 6 to the lower side of the deflecting roller 5, there is the returning segment 8" of the belt 8. To achieve this, measures are required such that the returning segments 7" and 8" do not rub against each other or against the feed segments 7' and 8'. For example, this can be achieved by slightly inclining the deflecting rollers 3, 4, 5 and 6. For this purpose, it would also be possible to use distancing rollers with a collar.

Inasmuch as, with the described flipping device 1, the flipping sheet 2 must be securely held by the segments 7' and 8' and must remain aligned during the flipping operation, at least three guide rollers 11, 12, and 13 are provided downstream of the crossing region 10. The guide rollers 11, 12 and 13 are alternately arranged on the segments 7' and 8' in such a manner that they slightly deflect the belts 7 and 8 out of the linear direction, so that the force of contact pressure of these segments 7' and 8' on the sheets 2 is increased, this requiring that the belts 7 and 8 be inherently elastic.

Inasmuch as the flipping sheet 2 applies transverse forces to the belts 7 and 8, at least one of the guide rollers 11, 12 and 13 is provided with at least one retaining collar 14. Preferably, the guide rollers 11, 12 and 13 are arranged in such a manner that two guide rollers 11 and 13 are located in the upper region and one lower guide roller 12 is arranged in between. The second upper guide roller 13 has a retaining collar 14 in the rear region, i.e., on side 15, on which the outer edge 16 of the sheet 2 moves in upward direction downstream of the crossing region 10. In this manner, it is assured that the absolute positioning and the reciprocal relative positions of the segments 7' and 8' are maintained and thus also the positioning of the relatively thin sheet 2.

FIG. 1 shows a perspective view of the flipping device. It shows how a sheet 2 is being flipped in the direction of the arrows 17. During the flipping process, the rear outside edge 16' moves upward at the start of the flipping device, i.e., toward the zenith, and the front outside edge 16 moves downward in the crossing region 10. Thereafter, the upper outside edge 16' moves forward and downward, and the lower outside edge 16 moves backward and upward, so that, at the end of the flipping device 1, the formerly rear outside edge 16' is in front and the formerly front outside edge 16 is in the back, whereby the terms "back" and "front" are with respect to the viewer of FIG. 1.

Guide arrangements 19, 20 and 21 are used to support the flipping operation. One guide arrangement 19 is used to guide the edge 16' of the sheet 2, whereby this guide arrangement 19 starts on the side 15—at which the outer edge 16' of the sheet 2 moves upward—and then extends forward in such a manner that the outer edge 16' is guided to the end position of the sheet 2 when said sheet leaves the flipping device 1. In the figure, only the guide arrangement 19 is depicted; for simplification, its mounts were omitted. In conjunction with this it is important that the guide arrangement 19 extend on the side 15 far enough toward the rear and be mounted in such a manner that the mount does not impair flipping the sheet 2.

Another guide arrangement 20 is used in that the outer edge 16, which moves upward downstream of the crossing region 10, is guided until the sheet 2 has reached the end position. In so doing, the edge 16, or the area of the sheet 2 following the edge 16, slides upward on the guide arrangement 20 until it reaches the horizontal plane.

The third guide arrangement 21 is used to support the edge 16' toward the end of the flipping operation, so that this edge cannot hang down. To do so, this guide arrangement 21 extends far enough toward the outside that it reaches the edge 16'. In FIG. 1, this guide arrangement is shown cut off in order to not completely hide the lower deflecting roller 4.

In FIG. 1, the embodiment also shows that each of the deflecting rollers 3, 4, 5 and 6 is provided with two retaining collars 14 in order to ensure secure guiding of the belts 7, 8, said belts being configured as V-belts.

FIG. 2 shows a considerably more schematic and basic plan view of an exemplary embodiment of a flipping device 1 based on the flipping device 1 depicted in FIG. 1. In FIG. 2, the flipping device 1 is indicated only as one line which—in plan view—corresponds approximately to the course of the segments of this flipping device, i.e., in this case, approximately parallel to a transport direction 30, in which a sheet 2*a*, 2*b* is being transported.

Conventionally, the flipping device 1 would be in alignment with the central axis 31*a* of the arriving sheet 2*a* and would flip the sheet 2a about this central line 31*a*, without transverse offset. However, in accordance with the invention, for example by insertion of suitable spacers 36, the flipping device 1 is offset parallel by a distance 32 transversely with respect to the transport direction 30. As a result of this, the sheet 2*a* moves off-center when moving into the flipping device 1. If the sheet is now flipped and its transport is continued as sheet 2*b*, the position 2*b* is offset by a distance 33 in transverse direction with respect to the position 2*a*, said distance 33 being twice the size of the offset 32 because the offset 32 affects the sheet 2 twice laterally reversed with respect to the flipping device 1 during the flipping operation. Therefore, the sheet 2*b* is transversely offset with its central axis 31*b* by the distance of the offset 33 relative to the central axis 31*a*. In FIG. 2, this is again indicated by the line 24 representing a type of course of the path.

The flipping webs or belts 7, 8, and thus the entire flipping device 1, in turn, could be offset transversely with respect to the transport direction 30, thus creating the offset 32, in that the deflecting rollers 3 through 6, for example, are shifted in transverse direction either continuously or are offset in transverse direction by means of spacers 36.

The invention claimed is:

1. Method for the alignment of a sheet in a direction transverse to its transport direction in a sheet-printing machine, comprising:

receiving the sheet with a central axis of the sheet aligned with the transport direction;

moving the sheet along the transport direction;

wherein the sheet is flipped about a flipping axis transversely offset and substantially parallel to the transport direction, and this flipping produces a determined transverse offset of the sheet-in the transverse direction.

2. Method of claim 1, wherein the sheet is flipped about a flipping axis, which is eccentrically offset by a distance parallel to its central axis extending in transport direction in such a manner that, due to the turn-over, the transverse offset exhibits approximately twice the size as the distance between the flipping axis and the central axis.

3. Method of claim 2, wherein the sheet is flipped by means of an adjustable flipping device.

4. Method of claim 1, wherein the sheet is flipped by means of an adjustable flipping device.

5. Device for the alignment of a sheet in a direction transverse (cross-track) to its transport direction in a sheet-printing machine comprising:

flipping webs approximately extending in transport direction and grasping and clamping between them the sheet by its two surfaces, said flipping webs being guided in a crossed and rotated manner such that they flip the sheet during its transport about a flipping axis;

spacers inserted to offset the flipping axis of the flipping device in relation to a central axis of the sheet moving in a transport direction into the flipping device, and wherein the spacers offset the flipping axis from the central axis by one half of a determined offset distance.

6. Device of claim 5, wherein the flipping webs are preferably arranged such that they can be offset parallel to each other.

* * * * *